United States Patent [19]

van den Broek

[11] Patent Number: 4,925,421

[45] Date of Patent: May 15, 1990

[54] METHOD OF MANUFACTURING A COLOR CATHODE-RAY TUBE AND A COLOR CATHODE-RAY TUBE

[75] Inventor: Adrianus P. van den Broek, Eindhoven, Netherlands

[73] Assignee: U.S. Philips Corporation, New York, N.Y.

[21] Appl. No.: 321,411

[22] Filed: Mar. 9, 1989

[30] Foreign Application Priority Data

Mar. 9, 1988 [NL] Netherlands ..... 8800581

[51] Int. Cl.[5] ..... H01J 29/07

[52] U.S. Cl. ..... 445/4; 445/30; 313/408

[58] Field of Search ..... 445/4, 30, 45; 313/408

[56] References Cited

U.S. PATENT DOCUMENTS

| | | | |
|---|---|---|---|
| 3,643,299 | 2/1972 | Brown | 445/3 |
| 4,373,237 | 3/1980 | Bakker et al. | 445/3 |
| 4,547,696 | 1/1984 | Strauss | 313/407 |
| 4,605,879 | 8/1986 | Rath | 445/30 |
| 4,678,447 | 7/1987 | Prazak | 445/45 |
| 4,790,785 | 12/1988 | Lee et al. | 445/45 |

*Primary Examiner*—Kenneth J. Ramsey

*Attorney, Agent, or Firm*—John C. Fox

[57] ABSTRACT

The invention relates to a method of manufacturing a color cathode ray tube, in which in one process step a color selection system and a glass display window having a display screen 2 are assembled. The color selection system and the display window are positioned relative to one another by optimizing a test pattern displayed on the display screen. The adjusted position of the parts relative to one another is then fixed by interconnecting weldable elements which are connected to the parts 1, 4, by means of laser welding through the glass.

20 Claims, 3 Drawing Sheets

METHOD OF MANUFACTURING A COLOR CATHODE-RAY TUBE AND A COLOR CATHODE-RAY TUBE

BACKGROUND OF THE INVENTION

The invention relates to a color cathode ray tube and a method of manufacturing such a colour cathode-ray tube, in which two parts, such as a colour selection system and an at least substantially rectangular display window having a display screen are secured to one another in one process step to form an assembly.

OBJECT AND SUMMARY OF THE INVENTION

It is an object of the invention to provide a method of manufacturing a colour cathode-ray tube, in which the manufacture of the colour selection system and the display window are carried out in a readily conceivable and accurate way.

To this end, a method of the type mentioned in the opening paragraph is characterized in accordance with the invention in that the two parts are secured to one another via a number of positioning elements. More particularly prior to securing the two parts to one another, the positioning elements together with one of the parts are moved over mounting elements secured to the other part, until the parts are accurately aligned relative to one another, after which the positioning elements and the mounting elements are fixedly secured to one another while maintaining this aligned position.

The invention is based on the insight that if the connection means used to secure the colour selection system to the display window are composed of two elements, i.e., the mounting elements and the positioning elements, the display window and the colour selection electrode can be accurately aligned relative to one another, and the position of the suspension means relative to the display window and the colour selection electrode can be fixed. Consequently, the display window with the display screen and the colour selection system can be produced separately in large numbers and a random colour selection system and a random display window can be joined to form an assembly in which their relative position is accurately aligned.

A preferred embodiment of a method according to the invention is characterized in that a test pattern is displayed on the display screen via the colour selection system, and in that the relative movement is continued until the test pattern is displayed in a desired manner indicating that an accurate alignment of the display window relative to the colour selection system has been obtained. In practice it has been found that the accurate alignment of the display window and the colour selection system can be carried out in a simple manner in a preferred embodiment of a method according to the invention by providing reference phosphor elements at the edge of the display screen and reference apertures are provided in the colour selection system, and displaying the test pattern, by means of a lamp emitting ultraviolet light on the reference phosphor elements at the edge of the display screen via the reference apertures in the colour selection system.

The principles of the invention can also advantageously be used to secure an assembly of a display window and a colour selection system to a tube enveloping part.

A further preferred embodiment of a method according to the invention is characterized in that the mounting elements and the positioning elements are made of metal and they are secured to one another by means of laser welding due to, among other things, the accuracy of the welds and the speed with which the welds can be formed.

A still further preferred embodiment of a method according to the invention is characterized in that at least one of the parts to be secured is at least partly made of glass, and is secured to another part by means of laser welding through the glass, whereby the aligned position can readily, quickly and accurately be fixed. Thus, the possibility of a deviation from the desired position during the short time necessary to fix the position by the said securing operation is small. Moreover, it becomes possible to weld the metal elements to one another when another way of interconnecting the elements is impossible due to obstructions present around the elements. Furthermore, such laser welding can be accomplished without excessively heating one or both elements and without softening the glass.

A still further preferred embodiment of a method according to the invention is characterized in that the positioning elements are detachably connected to the one part. This has the advantage that if in the course of the manufacture of the cathode ray tube it is necessary to detach the colour selection system from the display window or the tube enveloping part from the assembly, the parts can subsequently be readily attached to one another again in the same position relative to one another.

A further preferred embodiment of a method according to the invention is characterized in that each positioning element is provided with a cavity, and an intermediate element is arranged between each positioning element and the associated mounting element, which intermediate element lies at least partly against both the positioning element and the mountig element, the intermediate element extending at least partly in the said cavity and permitting a relative movement of the parts in a direction transverse to the display window, and, in the aligned position, each intermediate element being secured to the associated positioning element and mounting element. Thus, the frame and the display screen or the tube enveloping part and the assembly can readily be positioned in three directions relative to one another.

According to another aspect of the invention, a colour cathode-ray tube comprising an at least substantially rectangular display window provided with a display screen of phosphor elements luminescing in different colours, an electrode system for generating a number of electron beams, and a colour selection system having a great number of apertures located opposite the screen and aligned relative to the display window such that the apertures of the colour selection system ensure that each electron beam is incident on phosphor elements luminescing in one colour, is characterized in that the colour selection system is connected to the display window via a number of two-part connection elements, each part of which has a surface which extends parallel to the display window, these surfaces being movable relative to one another in a common plane during the alignment and these surfaces being rigidly connected to one another in the aligned position, whereby the tube operates satisfactorily, for example as regards colour purity.

BRIEF DESCRIPTION OF THE DRAWINGS

A few embodiments of the method according to the invention will now be described by way of example and with reference to the drawing, in which.

DESCRIPTION OF THE PREFERRED EMBODIMENTS

Figure 1:
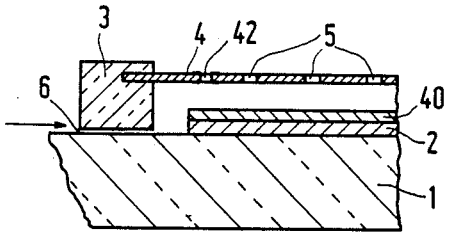
FIG. 1 is a schematic sectional view of a portion of a colour selection system and a display window.

In the manufacture of a colour cathode ray tube according to the invention, for example, a display screen of phosphor elements luminescing in different colours is obtained by providing a different pattern of phosphor elements for each colour on a display window by means of a master colour selection system. By means of a so-called master matrix, a large number of these colour selection systems are manufactured separately. FIG. 1 shows part of a display window 1 manufactured as described above and comprising a display screen 2. The display screen 2 is further covered with an aluminum layer 40. A colour selection system 4 mounted on a frame 3 and defining a large number of apertures 5 is placed on the display window 1. FIG. 1 shows, by way of example, both a flat display window 1 and a flat colour selection system 4. It will be clear that the invention is not limited to a method of manufacturing cathode ray tubes having a flat display window, but that it also relates to cathode ray tubes having curved display windows and curved colour selection systems. The positioning of the display window 1 relative to the colour selection system 4 can for example be carried out by means of a test pattern which is incident on the phosphor elements of the display screen 2 through the apertures 5 of the colour selection system 4. In an embodiment of the positioning operation, the display screen 2 contains at its edge a few reference phosphor elements 41, shown in FIG. 2, which are not covered by the aluminium layer, and the colour selection system 4 contains a few reference apertures 42. By means of a lamp (not shown) emitting ultraviolet light, a test pattern is displayed on the display screen 2 via the colour selection system 4. Subsequently, the colour selection system 4 and the display window 2 are moved relative to one another such that the test pattern passing through the reference apertures 42 is optimally displayed on the reference phosphor elements 41 of the display screen 2, so that the display window 2 and the colour selection system 4 are accurately aligned relative to one another. Next, the display window 1 must be secured in this aligned position to the frame 3, for example by fusing the frame 3 and the display window 1 by means of a gas flame at the location of the pasted seam 6. An alternative, simple, quick and accurate manner of fixing this aligned position is the fusing together of the display window 1 and the frame 3 by means of a laser. In this case, a laser supplies energy at the location of the pasted seam 6 (see the arrow in FIG. 1) causing the display window 1 and the frame 3 to fuse together.

Figure 2:
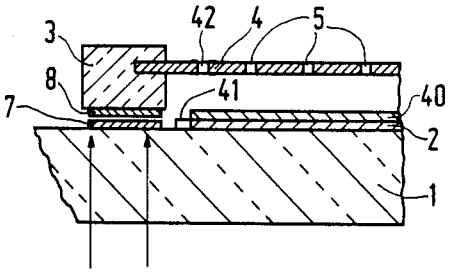
FIG. 2 is a schematic sectional view similar to that of FIG. 1 in which the display window and a frame of the system are both provided with a metal element.

An accurate and solid fixation of the aligned position may also be obtained by providing the display window 1 with a metal mounting element 7 outside the area of the display screen 2, as is shown in FIG. 2. The frame 3 is also provided with a metal mounting element 8. The metal of which the auxiliary elements are made has a coefficient of thermal expansion which is substantially equal to the coefficient of thermal expansion of the material of which the parts are made, in the present example glass. The attachment of the metal mounting element can be carried out, for example, by fusing the element into the display window 1 or by securing it to the display window 1 by means of a "solid-state" connection. A quick, clean and efficient method of securing such a metal element is the technique which is known as thermocompression bonding.

The frame 3 and the display window 1 are next placed on top of each other such that the two metal elements 7, 8 lie against one another. When the position relative to one another has been accurately adjusted by means of a test pattern, the two elements are secured to one another, for example, by means of laser welding. The laser beams used in the laser welding operation (see arrows in FIG. 2) pass through the display window 1, which is made of glass, to interconnect the two elements. In order to obtain a proper weld the laser beam must be properly focussed on the metal elements, and the energy-supply by the laser beam must be properly adjusted. In practice it has been found that by means of a pulsed Nd-YAG laser having a pulse width of 3.75 msec and an energy of 2.3 J and a wavelength of 1.06 μm, a proper connection can be formed, the material from which the frame 3 and the display window 1 are manufactured being undamaged or damaged to only a negligible extent. In order to secure a proper passage of the laser beams the surface of the glass of the display window must be polished.

Figure 3:
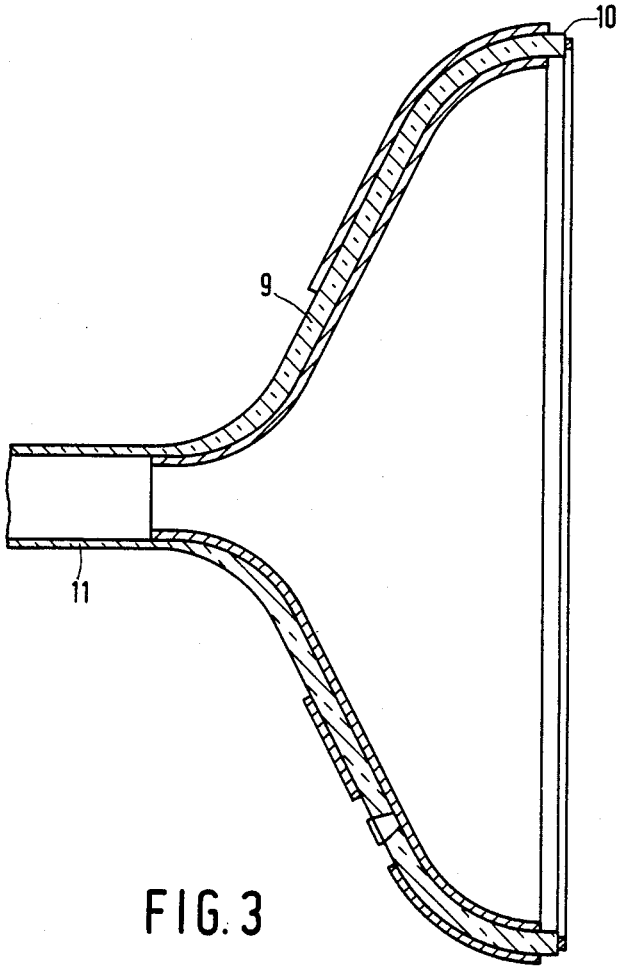
FIG. 3 is a schematic sectional view of a tube enveloping part of a colour cathode-ray tube.

FIG. 3 shows an enveloping part 9 of a cathode-ray tube, which comprises an at least substantially rectangular peripheral edge 10 and a neck 11. The enveloping part 9, which is funnel-shaped in the present example, may be made entirely of glass or, in an alternative embodiment, may be partly made of metal. If the cathode-ray tube is a flat type in which the enveloping part is box-shaped, the method according to the invention can also be used. To obtain a properly functioning display device, it is advantageous if the enveloping part and an assembly of a colour selection system and a display window are accurately aligned relative to one another before being secured to one another by means of a sealing process, the so-called "frit sealing".

To position the enveloping part relative to the assembly, use can be made of, for example, reference holes in the colour selection system, reference phosphor elements on the display screen and a lamp emitting ultraviolet light which is situated in the neck of the enveloping part. By means of the lamp a test pattern is displayed on the display screen and the enveloping part and the assembly are positioned relative to one another such that the test pattern passing through the reference apertures is displayed on the reference phosphor elements of the display screen in a desired manner.

In the manufacture of a colour cathode-ray tube, in general, the display window is completed first, i.e. it is provided with, inter alia, the display screen and an aluminium layer and subsequently, the display window and the colour selection system are secured to one another to form an assembly, after which the assembly is placed against the enveloping part and seal to it using a glass frit.

Figure 4:
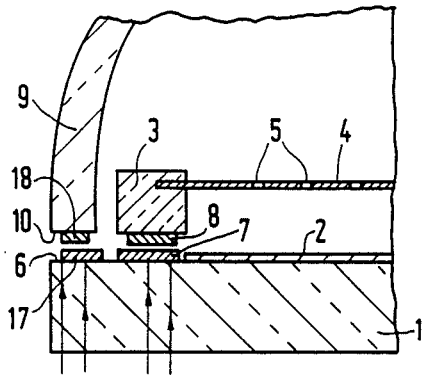
FIGS. 4 and 5 are schematic sectional views of an envelope comprising an enveloping part, a display window and a colour selection system, which are all provided with at least one metal element.

FIG. 4 is a schematic sectional view of an envelope according to the invention, comprising an enveloping part 9, a display window 1 and a frame 3 of a flat colour selection system 4, each of which is provided with at least one metal element. To secure the enveloping part 9 to the assembly of the window 1 and system 4, it is provided on the edge 10 with a metal positioning element 18 and the assembly is provided with a metal mounting element 17. The enveloping part 9 is secured to the assembly by interconnecting the metal elements 17 and 18 by means of laser welding. The elements 7 and 17 may be joined to form one element.

Figure 5:
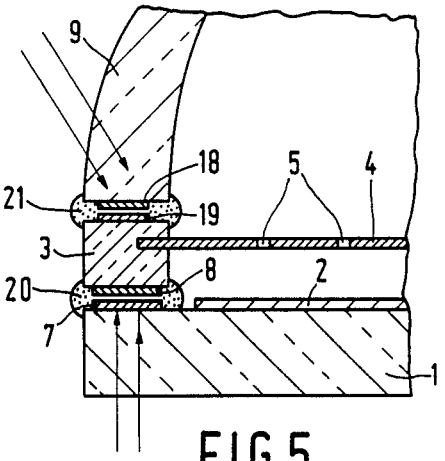

A simple way of positioning the parts relative to one another is described with reference to FIG. 5. Around the periphery of display screen 2, the display window 1 is provided with a metal mounting element 7 and the frame 3 is provided with a metal positioning element 8. The enveloping part 9 is provided with a metal positioning element 18 and the frame 3 is provided with a metal mounting element 19. A test pattern is optimized by positioning the frame 3 and the display window 1 relative to one another. Positioning can readily be carried out by taking each part separately and moving them relative to one another until the test pattern is displayed optimally. The adjusted position is fixed by interconnecting the element 7 and the element 8 by means of laser welding through the glass parts (see arrows FIG. 5). Subsequently, the enveloping part 9 is secured to the frame 3 by connecting the element 19 in an aligned position. The display window 1, the frame 3 and the enveloping part 9 are finally secured to one another in a sealing process using a glass frit 20, 21.

Figure 6:
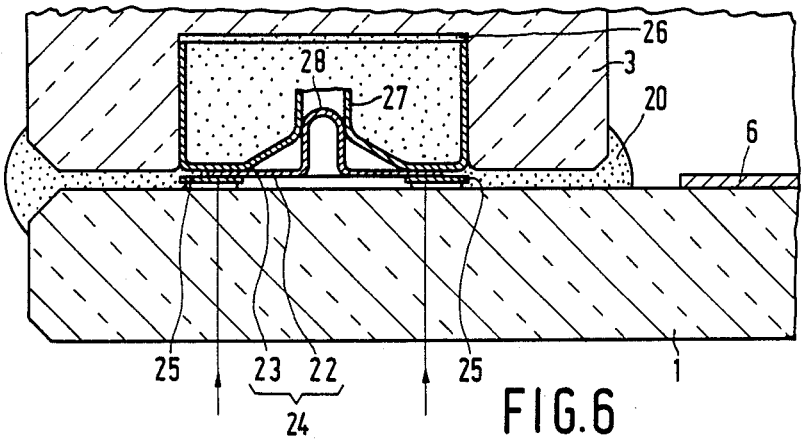
FIG. 6 is a schematic sectional view showing an embodiment of a connection arrangement of two metal elements, and one intermediate element located between the two elements.

If an intermediate element 22 is located between the two elements 23, 25 as is shown in FIG. 6, it becomes possible to detach and subsequently replace in the same position the positioned parts. In FIG. 6, the securing of the display window 1 to the frame 3 is shown by way of example. However, the assembly can also be secured to the enveloping part in a similar manner. The element 23 is secured in an aperture 26 of the frame 3 and comprises a cavity, for example in the form of a cylindrical portion 27 which is, for example, triangular in cross-section. A projection 28 engages the element 23 to secure the intermediate element 22 to the latter. An annular metal element 25 is provided on the display window 1. The position of the display window 1 relative to the frame 3 can be adjusted by means of a test pattern. If the desired position has been obtained, the element 25 is secured to the intermediate element 22 by means of laser welding through the display window 1 (see arrows in FIG. 6). Subsequently, the frame 3 with the colour selection system can be removed from the display window 1 by separating the element 23 and the intermediate element 22 from one another. The display window 1 and the frame 3 are finally secured to one another, for example, in a sealing process using a glass frit. The glass frit 20 is provided between the frame 3 and the display window 1. On account of this, the projection 28 of intermediate element 22 does not lie against the cylindrical part 27. The glass frit 20 is softened in the sealing process, such that the projection 28 engages again against the cylindrical part 27. Owing to this, the display window 1 and the frame 3 resume the desired position relative to one another. The intermediate element 22 permits an accurate and reproducible positioning of the frame 3 relative to the display window 1.

Figure 7:
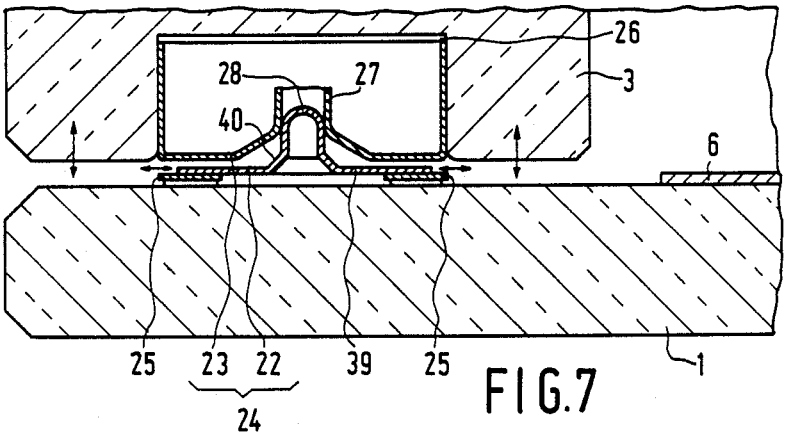
FIG. 7 is a view similar to that of FIG. 6 showing an alternative embodiment of a connection arrangement of two metal elements, and one intermediate element located between the two elements.

A very simple manner of positioning the frame and the display screen or the enveloping part and the assembly in three directions relative to one another is obtained by using an intermediate element which permits movement of the elements relative to one another in a direction transverse to the display window. An embodiment of such an intermediate element is described in more detail with reference to FIG. 7. FIG. 7 schematically shows a flat display window 1 comprising a display screen 6. By means of thermocompression, a metal annular mounting element 25 is provided on the display window 1 outside the display screen 6. A frame 3 on which a colour selection system (not shown in FIG. 7) is mounted is provided with an aperture 26 in which a positioning element 23 is secured. The element 23 comprises a cavity in the form of a cylindrical part which is, for example, triangular in cross-section. The intermediate element 22 is resiliently constructed and comprises a projection 28 which can be engaged in the cavity of element 23.

A bidirectional positioning of the frame 3 relative to the display window 1 in the plane of the display window 1 is obtained, for example, by holding the display window 1 and the frame 3 and moving them relative to one another in the plane of the display window 1. A positioning in a direction transverse to the plane of the display window 1 is obtained by means of the intermediate element 22. The intermediate element 22 comprises an annular base 39, a conical part 40 and the projection 28. The positioning element 23 is fitted onto the projection 28. Consequently, the element 23 is clear of the annular base 39. A movement in a direction transverse to the plane of the display window 1 is obtained by moving the frame 3 up and down (see vertical arrows in FIG. 7) relative to the display window 1. As a result of the resilient deflection of the intermediate element 22 under the influence of the conical part 40, the base 39 moves relative to the annular first element 25 in a direction in the plane of the display window 1 (see horizontal arrows in FIG. 7). The distance between the frame 3 (and, hence, the colour selection system) and the display window can be varied in this way. The colour selection system and the display window are positioned relative to one another by means of a test pattern which is displayed on the display screen via the colour selection system. If the desired position is obtained, the intermediate element 22 is secured to the positioning element 23 and to the mounting element 25, for example by means of laser welding, to fix the adjusted position.

Figure 8:
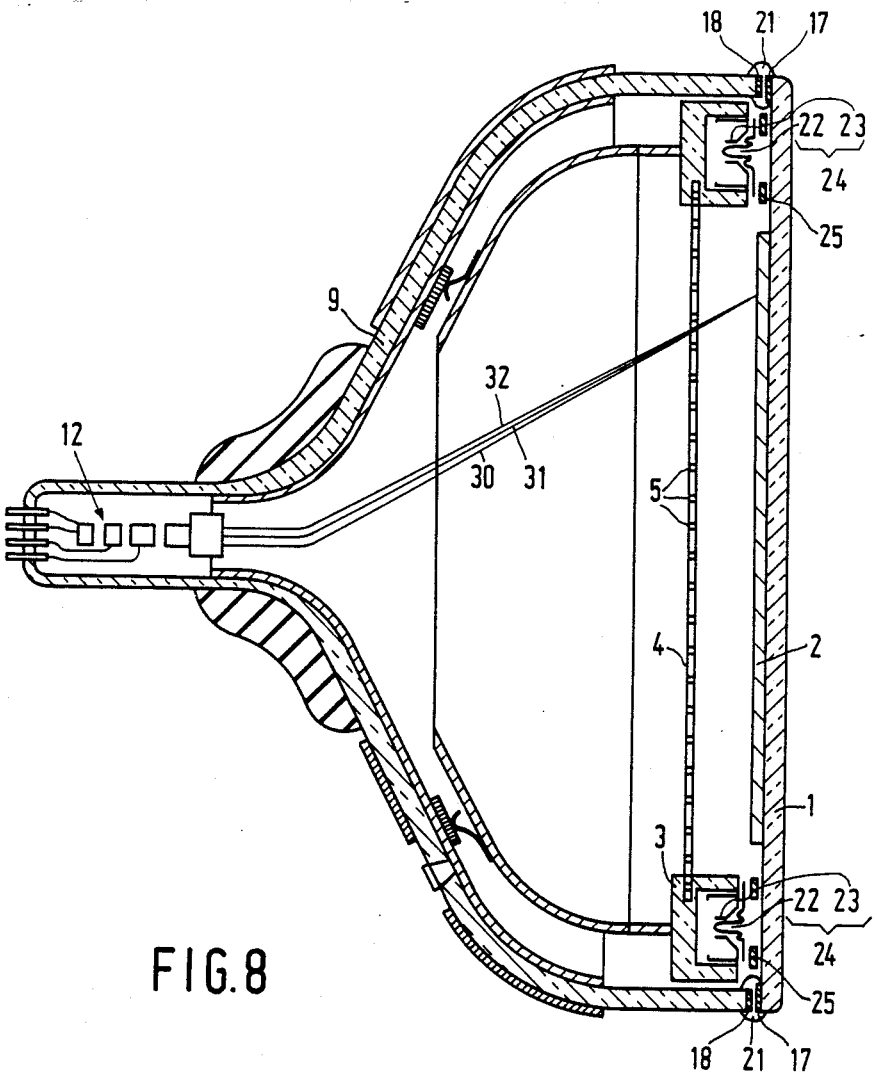
FIG. 8 is a schematic sectional view of a colour cathode ray tube, the parts of which are interconnected by means of metal elements.

FIG. 8 is a sectional view of a cathode-ray tube, in which a funnel-shaped enveloping part 9, a frame 3, and a substantially rectangular display window 1 are secured to one another by means of metal elements 17, 18, 24 and 25 which are provided in each corner of the display window 1. To generate three electron beams 30, 31 and 32, the enveloping part 9 is provided with an electrode system 12. A substantially rectangular colour selection system 4 having a large number of apertures 5 is provided on the frame 3. The display window 1 comprises a display screen 2 having phosphor elements luminescing in different colours. Prior securing, the enveloping part 9, the colour selection system 4 on the frame 3 and the display screen 2 on the display window 1 are positioned relative to one another such that the apertures 5 of the colour selection system 4 ensure that each electron beam is incident on phosphor elements luminescing in one colour. Outside the display screen, each corner of the display window 1 is provided with an annular mounting element 25 and a mounting element 17. The enveloping part 9 is provided with a positioning element 18 which is secured to element 17, and the frame 3 comprises a positioning element 23 and an intermediate element 22 which together constitute element 24 which is secured to the annular element 25. The enveloping part 9 and the display window 1 are sealed to one another in a vacuum-tight manner by means of a glass frit 20.

Of course, the present invention is not limited to the embodiments described above, and within the scope of the invention many variations are possible which will occur to those skilled in the art. For example, the shape of the elements to be interconnected and the material of which they are composed can be varied as long as they remain interconnectable.

I claim:

1. A method of manufacturing a colour cathode-ray tube, in which in one process step two parts, comprised of a colour selection system and an at least substantially rectangular display window having a display screen of phosphor elements luminescing in different colours are secured to one another to form an assembly, characterized by: securing the two parts to one another via a number of mounting elements and positioning elements; said mounting and positioning elements having cooperating parallel surfaces for permitting relative movement in a plane parallel to the display window; prior to securing the two parts to one another, moving the positioning elements

2. A method as claimed in claim 1, characterized in that a test pattern is displayed on the display screen via the colour selection system, and in that aligning is continued until the test pattern is displayed in a desired manner.

3. A method as claimed in claim 2, characterized in that reference phosphor elements are provided at the edge of the display screen and reference apertures are formed in the colour selection system, a test pattern is displayed by means of a lamp emitting ultraviolet light on the reference phosphor elements at the edge of the display screen via the reference apertures in the colour selection system, and aligning is continued until the test pattern is displayed in a desired manner.

4. A method as claimed in claim 3, characterized in that the positioning elements are detachably connected to the one part.

5. A method as claimed in claim 4, characterized in that the mounting elements and the positioning elements are made of metal and are secured to one another by means of laser welding.

6. A method as claimed in claim 3, characterized in that the mounting elements and the positioning elements are made of metal and are secured to one another by means of laser welding.

7. A method of manufacturing a colour cathode-ray tube, in which in one process step two parts, comprised of a tube enveloping part having an edge and an assembly of a colour selection system and a display window are secured to one another, characterized by: securing the two parts to one another via a number of mounting elements and positioning elements, said mounting and positioning elements having cooperating parallel surfaces for permitting relative movement in a plane parallel to the display window; prior to securing the two parts to one another, moving the positioning elements together with one of the parts over mounting elements secured to the other part, until the parts are accurately aligned relative to one another; and securing said cooperating surfaces of the positioning elements and the mounting elements to one another while this aligned position is maintained.

8. A method as claimed in claim 7, characterized in that the mounting elements and the positioning elements are made of metal and are secured to one another by means of laser welding.

9. A method as claimed in claim 8, characterized in that at least one of the members to be secured to one another is at least partly made of glass, and they are secured to one another by means of laser welding through the glass.

10. A method as claimed in claim 7, characterized in that the positioning elements are detachably connected to the one part.

11. A method as claimed in claim 5, characterized in that each positioning element is provided with a cavity, and an intermediate element is arranged between each positioning element and the associated mounting element, which intermediate element lies at least partly against the positioning element and the mounting element, the intermediate element extending at least partly in the said cavity and permitting a relative movement of the parts in a direction transverse to the display window, and, in the aligned position, each intermediate element being secured to the associated positioning element and mounting element.

12. A colour cathode-ray tube, comprising an at least substantially rectangular display window which is provided with a display screen with phosphor elements luminescing in different colours, an electrode system for generating a number of electron beams, and a colour selection system having a large number of apertures located opposite and being aligned relative to the display window such that the apertures of the colour selection system ensure that each electron beam is incident on phosphor elements luminescing in one colour, characterized in that the colour selection system is connected to the display window via a number of two-part connection elements, each part of which has a surface which extends parallel to the display window, these surfaces being movable relative to one another in a common plane during the alignment, and these surfaces being rigidly connected to one another in the aligned position.

13. A method as claimed in claim 1, characterized in that the mounting elements and the positioning elements are made of metal and are secured to one another by means of laser welding.

14. A method as claimed in claim 1, characterized in that each positioning element is provided with a cavity, and an intermediate element is arranged between each positioning element and the associated mounting element, which intermediate element lies at least partly against the positioning element and the mounting element, the intermediate element extending at least partly in the said cavity and permitting a relative movement of the parts in a direction transverse to the display window, and, in the aligned position, each intermediate element being secured to the associated positioning element and mounting element.

15. A method as claimed in claim 1, characterized in that the positioning elements are detachably connected to the one part.

16. A method as claimed in claim 15, characterized in that the mounting elements and the positioning elements are made of metal and are secured to one another by means of laser welding.

17. A method as claimed in claim 16, characterized in that at least one of the members to be secured to one another is at least partly made of glass, and they are secured to one another by means of laser welding through the glass.

18. A method as claimed in claim 1, characterized in that reference phosphor elements are provided at the edge of the display screen and reference apertures are formed in the colour selection systems, a test pattern being displayed, by means of a lamp emitting ultraviolet light, on the reference phosphor elements at the edge of the display screen, via the reference apertures in the colour selection system, and in that aligning is continued until the test pattern is displayed in a desired manner.

19. A method as claimed in claim 18, characterized in that the mounting element and the positioning elements are made of metal and are secured to one another by means of laser welding.

20. A method as claimed in claim 19, characterized in that at least one of the members to be secured to one another is at least partly made of glass, and they are secured to one another by means of laser welding through the glass.

* * * * *